United States Patent [19]

Miura

[11] 4,335,692

[45] Jun. 22, 1982

[54] SPARK IGNITION TIMING CONTROL SYSTEM FOR INTERNAL COMBUSTION ENGINES

[75] Inventor: Nobuo Miura, Wako, Japan

[73] Assignee: Honda Giken Kogyo Kabushiki Kaisha, Tokyo, Japan

[21] Appl. No.: 95,208

[22] Filed: Nov. 19, 1979

[30] Foreign Application Priority Data

Nov. 27, 1979 [JP] Japan ..... 53-146402

[51] Int. Cl.[3] ..... F02P 5/08

[52] U.S. Cl. ..... 123/418; 123/602

[58] Field of Search ..... 123/418, 599, 600, 601, 123/602

[56] References Cited

U.S. PATENT DOCUMENTS

| | | | |
|---|---|---|---|
| 3,515,109 | 6/1970 | Farr | 123/149 |
| 3,722,488 | 3/1973 | Swift et.al. | 123/149 D |
| 3,861,372 | 1/1975 | Shibukawa et al. | 123/602 |
| 3,866,589 | 2/1975 | Haubner et al. | 123/602 |
| 4,132,208 | 1/1979 | Yukawa | 123/602 |
| 4,150,652 | 4/1979 | Nagasawa | 123/602 |
| 4,204,490 | 5/1980 | Ohki et al. | 123/652 X |

FOREIGN PATENT DOCUMENTS

| | | |
|---|---|---|
| 2345512 | 3/1975 | Fed. Rep. of Germany . |
| 1353588 | 5/1974 | United Kingdom . |

*Primary Examiner*—Tony M. Argenbright

*Attorney, Agent, or Firm*—Lyon & Lyon

[57] ABSTRACT

An ignition timing control system for retarding the spark of a spark plug wherein the ignition timing is regulated to be practically constant while the engine speed is within a low range, but wherein the ignition timing is retarded in proportion to an increase in engine speed as the engine speed increases over a given speed. The system is applicable to capacitive discharge ignition systems and includes a control circuit for triggering the capacitive discharge system as a function of engine speed. The control circuit includes a pick-up coil for generating a voltage having an amplitude proportional to engine speed, and for providing a trigger signal at the peak of the voltage waveform when the voltage waveform is below a preset value. When the voltage waveform exceeds this value, as determined by a limit circuit, the trigger signal is generated as the voltage waveform falls from its peak and reaches the preset value. A zener diode may be used to set the limit or preset value, and several embodiments of suitable control circuits are illustrated.

10 Claims, 6 Drawing Figures

SPARK IGNITION TIMING CONTROL SYSTEM FOR INTERNAL COMBUSTION ENGINES

SUMMARY OF THE INVENTION

This invention relates to a spark ignition timing control system for internal combustion engines, and is particularly directed to improvements in such control systems for retarding the ignition timing at engine speeds exceeding a preset value.

Various systems have been developed for varying ignition timing. Usually, the ignition timing of an internal combustion engine is advanced with an increase of engine speed. However, with two-cycle engines, it has been found that when the engine speed exceeds a given value it is desirable to retard the ignition timing in order to increase the output power and reduce spark plug wear.

Accordingly, it is an object of this invention to provide an improved spark ignition timing control system for internal combustion engines.

Another object of the invention is to provide a capacitive discharge ignition system which is capable of retarding the ignition timing in proportion to engine speed when the engine speed exceeds a given value.

In an exemplary embodiment of the present invention, a control circuit is provided for supplying ignition timing pulses to the ignition system which conventionally includes a power source, capacitor, ignition coil and spark plug. The control system in an exemplary embodiment employs a pick-up coil for providing a waveform having a voltage proportional to engine speed. This waveform is an AC voltage which is synchronized with the revolutions of the internal combustion engine. The generated AC voltage is rectified, and a limit circuit limits the amplitude of the resulting rectified pulsating voltage to a preset level. A trigger circuit is provided which detects the decrease or particular falling point of this limited rectified voltage wave to, in turn, generate a trigger signal which is applied to a switching element, such as a thyristor, in the ignition circuit. The trigger signal causes the generation of a high voltage to fire the spark plug.

DESCRIPTION OF THE DRAWINGS

Turning now to the drawings, FIG. 1 is a circuit diagram of a first embodiment of a spark ignition timing control system according to this invention. The circuit of FIG. 1 includes an ignition circuit with condenser charging coil Ex, diodes D2 and D3, a condenser C1, an ignition coil IG, a spark plug PI and a thyristor Th. As is known, the condenser charging coil Ex is a coil, for example of a fly wheel magnet mounted on a crank shaft of an engine (not shown), and generates an AC voltage when the engine is operating. The voltage across the coil Ex is half-wave rectified by a diode D3 to charge a condenser C1 of the ignition system. The thyristor is gated on to discharge the condenser into the primary of the ignition coil IG in a manner well known to those skilled in the art.

An AC ignition signal voltage is generated by a pick-up coil P and is shown in FIG. 2(P). The peak value of the voltage developed by the coil P increases as the engine speed increases as indicated by the different amplitude waveforms N1, N2 and N3 of FIG. 2(P). A line 10 in FIG. 2(P) diagrammetically represents a given voltage level for a given engine speed and represents a preset or predetermined engine speed.

Figure 1:
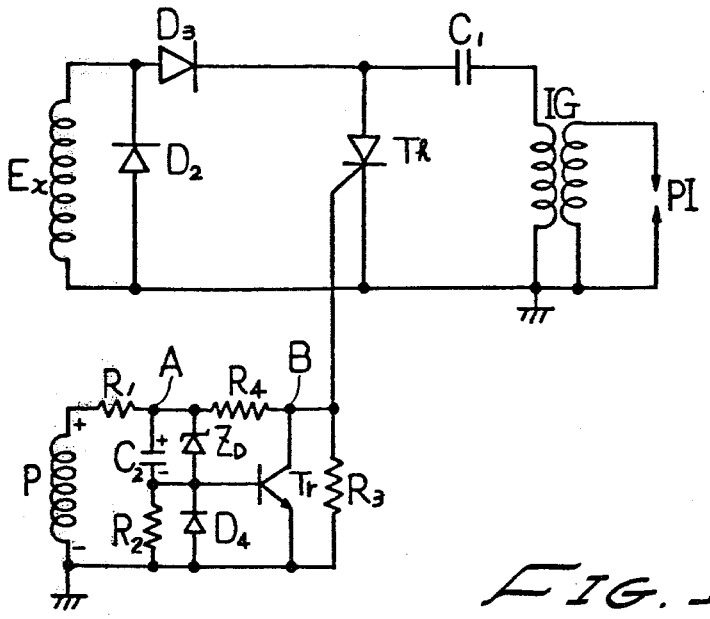
FIG. 1 is a circuit diagram of an embodiment of this invention.

The waveform N1 of FIG. 2(P) is below the preset value 10 and within a range where the number of revolutions or engine speed is low, and the peak value of the voltage generated by the pick-up coil P does not exceed the zener voltage of a zener diode ZD. When the pick-up coil P generates a voltage which is positive at the upper terminal of the coil P, and as illustrated by the waveform N1, current flows, as the voltage increases, through the coil P, a resistor R1, a condenser C2, the base of a transistor Tr, the emitter of the transistor Tr, and back to the pick-up coil P. This causes the transistor Tr to conduct and the condenser C2 to charge. Consequently, the voltage at point B, which is the gate potential for the thyristor Th, is equal to ground since the transistor Tr is conducting. When the peak value 7 of the generated voltage from the pick-up coil P is lower than the zener voltage of the zener diode ZD, the above operation continues until the generated voltage reaches the peak value 7. Then, when the generated voltage passes the peak value, the base current of the transistor Tr ceases to flow, thereby turning off the transistor Tr. Consequently, the voltage at point B rises immediately from ground, causing current to flow from the pick-up coil P into the circuit of the resistor R1, to resistor R4, and to the gate of the thyristor Th. This is illustrated by the waveform N1 in FIG. 2(B) which shows the waveforms at point B in the circuit of FIG. 1. Therefore, the trigger voltage as shown by the waveform N1 of FIG. 2(B) occurs at point B and at the gate of the thyristor Th, causing the thyristor Th to conduct. When the thyristor Th conducts, as is well known in the art, the charge of the condenser C1 is discharged through the ignition coil IG to the spark plug PI. Stated differently, within the range where the engine speed is low and the generated voltage of the pick-up coil P does not exceed the zener voltage of the zener diode ZD, and as indicated by the line 10 of FIG. 2(P), the peak point 7 of the generated voltage wave N1 of FIG. 2(P) is the ignition timing as indicated by the waveform N1 of FIG. 2(B).

As the engine speed increases to cause the generated voltage from the pick-up coil P to exceed the zener voltage of the zener diode ZD, the voltage at point A between resistors R1 and R4 is clamped as shown by either of the waves N2 or N3 of FIG. 2(A), which shows the waveforms at point A, at the zener voltage level and is regulated at a fixed value. In this case, current flows through the circuit of the pick-up coil P, through the resistor R1, the zener diode ZD, the base of the transistor Tr, and the emitter of the transistor Tr, thereby allowing the transistor Tr to remain in conduction. As the waveform increases to its peak 8 and begins to fall, it again falls below the zener voltage as indicated by the line 10 of FIGS. 2(A) and 2(P). When this occurs, the base current of the transistor Tr is terminated thereby causing the transistor Tr to turn off. Consequently, the thyristor Th conducts as described previously, causing the spark plug PI to spark.

Stated differently, in this latter state, the ignition timing is provided at the instant when the generated voltage of the pick-up coil P becomes lower at 9 than the zener voltage after exceeding its peak value 8. This timing pulse is shown by waveform N2 of FIG. 2(B).

Similarly, the output voltage of the pick-up coil P becomes even greater as the engine speed further increases as shown by waveform N3 of FIG. 2(P), but the zener voltage remains constant as indicated by line 10 of FIGS. 2(P) and 2(A). As can be seen from FIG. 2(B) the ignition timing wave N3 corresponding to the pick-up coil waveform N3 of FIG. 2(P) occurs at a later time as the engine speed increases further. Accordingly, it will be apparent that as the voltage of the coil P becomes greater as the engine speed increases, and because the zener voltage is constant, the timing is retarded because the point at which the coil output voltage N3 of FIG. 2(P) falls below the zener voltage as indicated by line 10 after exceeding the peak of the waveform occurs later. Accordingly, the ignition timing is retarded in a proportional manner.

Figure 2:
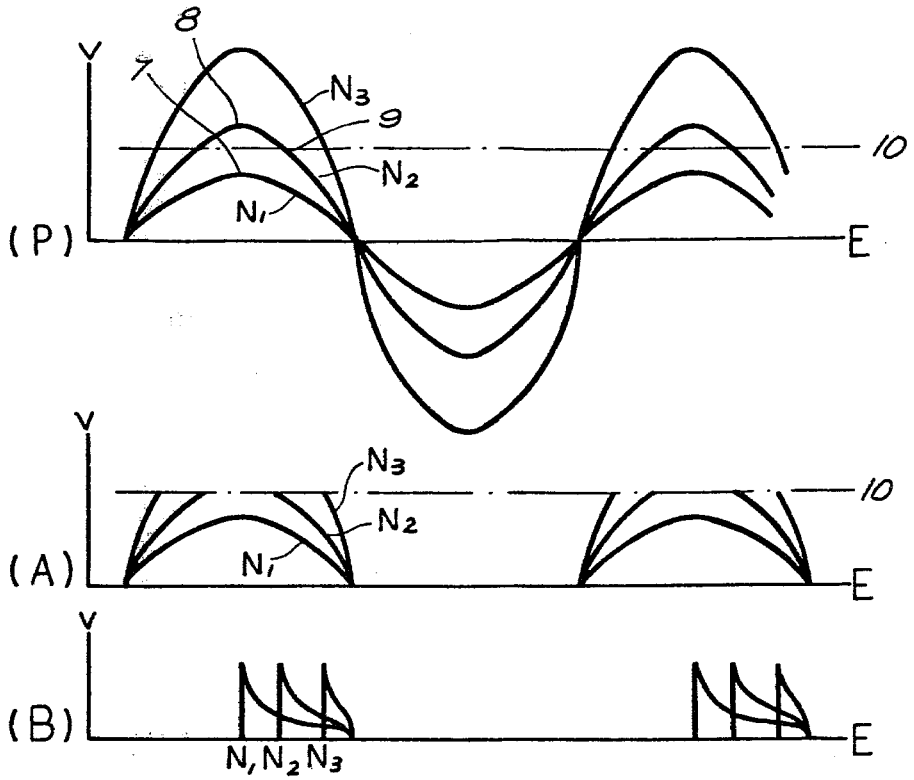
FIG. 2 illustrates waveforms for different labeled points in the circuit of FIG. 1.

Considering again the waveforms of FIG. 2, it will be seen that when the voltage of the coil P as shown by waveform N1 of FIG. 2(P) does not reach the zener voltage level as indicated by line 10, the ignition timing pulse N1 of FIG. 2(B) occurs at the peak 7 of waveform N1 of FIG. 2(P). As the engine speed increases, a waveform like N2 of FIG. 2(P) is generated by the coil P and it is of greater magnitude and crosses the line 10. After this waveform N2 of FIG. 2(P) reaches its peak 8, falls and again crosses the zener voltage level at 9, the ignition timing pulse N2 of FIG. 2(B) is generated. Similarly, as the engine speed further increases as indicated by waveform N3 of FIG. 2(P), the point where this waveform falls and crosses the line 10 occurs even later thereby generating a later ignition pulse N 3 as shown in FIG. 2(B).

Figure 3:
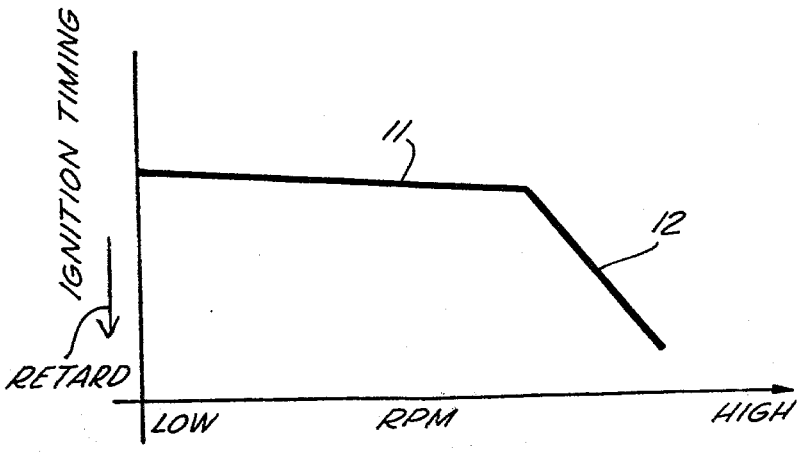
FIG. 3 is a chart illustrating an example of the relationship between engine speed and ignition timing provided by the circuit of FIG. 1.

An example of the relationship between engine speed and ignition timing is diagrammetically illustrated in FIG. 3. Even when the generated voltage of the pick-up coil P is less than the zener voltage, the ignition timing is retarded slightly as illustrated by the slightly slopping line 11 of FIG. 3 because of the time constant of condenser C2 and resistor R2 in proportion to the increase of the engine speed. As the engine speed further increases, the ignition timing is retarded even further as indicated by the slopping line 12 of FIG. 3, and as typified by the ignition timing pulses N1, N2 and N3 of FIG. 2(B). An example preset value engine speed at which the transistion from line 11 to line 12 occurs and retarding of timing begins is 6000 RPM.

Figure 4:
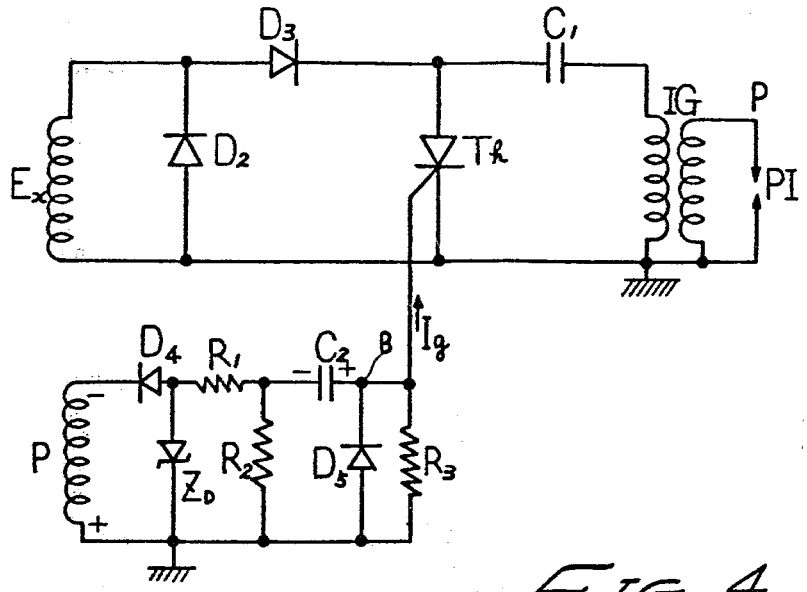
FIG. 4 is a circuit diagram of a second embodiment of this invention.
Figure 5:
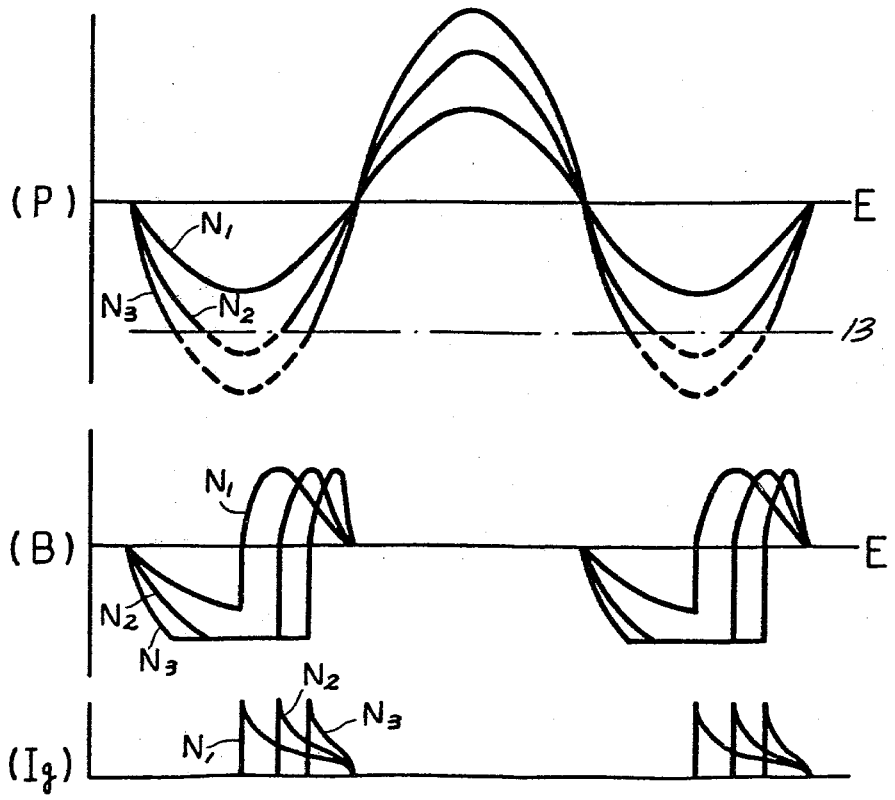
FIG. 5 illustrates waveforms of points in the circuit of FIG. 4.

Turning now to FIG. 4, a second embodiment of the invention is illustrated therein, and FIG. 5 illustrates waveforms similar to those of FIG. 2. The same letters and numbers designate the same or equivalent components and waveforms between FIGS. 1 and 4 and FIGS. 2 and 5. When a voltage having a polarity as shown in FIG. 5(P), namely waveform N1, is generated in the pick-up coil P, the condenser C2 is charged in the circuit including the pick-up coil P, the diode D5, the condenser C2, the resistor R1, the diode D4 and back to the coil P. When this generated voltage is lower than the zener voltage of the zener diode ZD, as illustrated by waveform N1 of FIG. 5(P), the voltage at the gate of the thyristor Th (point B) changes like the waveform N1 in FIG. 5(B) with the change of the generated voltage. When the generated voltage passes its peak point and starts to fall, the condenser C2 starts to discharge. The discharge current flows from the condenser C2 to the gate of the thyristor Th, the cathode of the thyristor Th, to ground, to the resistor R2, and back to the condenser C2. The waveform of the trigger current at the gate of the thyristor Th is illustrated by N1 in FIG. 5(Ig) and, accordingly, the spark plug P1 fires. Under this condition, the peak point of the generated wave N1 of FIG. 5(P) determines the ignition timing as shown by pulse N1 of FIG. 5(Ig).

Again, as the engine speed increases, the generated voltage from the coil P exceeds the zener voltage as shown by either of the waveforms N2 or in N3 of FIG. 5(P). During the period these waveforms exceed a given level as indicated by line 13 of FIG. 5(P), current flows through the circuit of the pick-up coil P, of the zener diode ZD, the diode D4 and back to the coil P, such that the terminal voltage of the condenser C2 is clamped to a practically constant value. When the generated voltage N2 or N3 of FIG. 5(P) passes its peak and again rises to a lower value than the zener voltage, the charge on the condenser C2 is discharged through the circuit of the condenser C2, the gate of the thyristor Th, the cathode of the thyristor Th, ground, the resistor R2 and back to the condenser C2, whereby the thyristor Th is triggered again firing the spark plug PI. In other words, in this embodiment as in the embodiment of FIG. 1, when the generated voltage of the pick-up coil P reaches the zener voltage level after passing the peak of the waveform represents the ignition timing, which ignition timing is retarded in proportion to the increase of the engine speed. This is illustrated in FIG. 5, as was the case with FIG. 2, by the ignition timing pulses in N1, N2, and N3 of FIG. 5(Ig), and it will be seen that these pulses are generated in a manner similar to that shown in FIG. 2. That is, the ignition pulse N1 of FIG. 5(Ig) is generated when waveform N1 of FIG. 5(P) reaches its peak, and the ignition pulses N2 and N3 of FIG. 5(Ig) are generated when the respective waveforms N2 and N3 of FIG. 5(P) reach the zener voltage as indicated by line 13 after these waveforms have reached their peak and return to the zener voltage level as they move toward the zero crossing.

Figure 6:
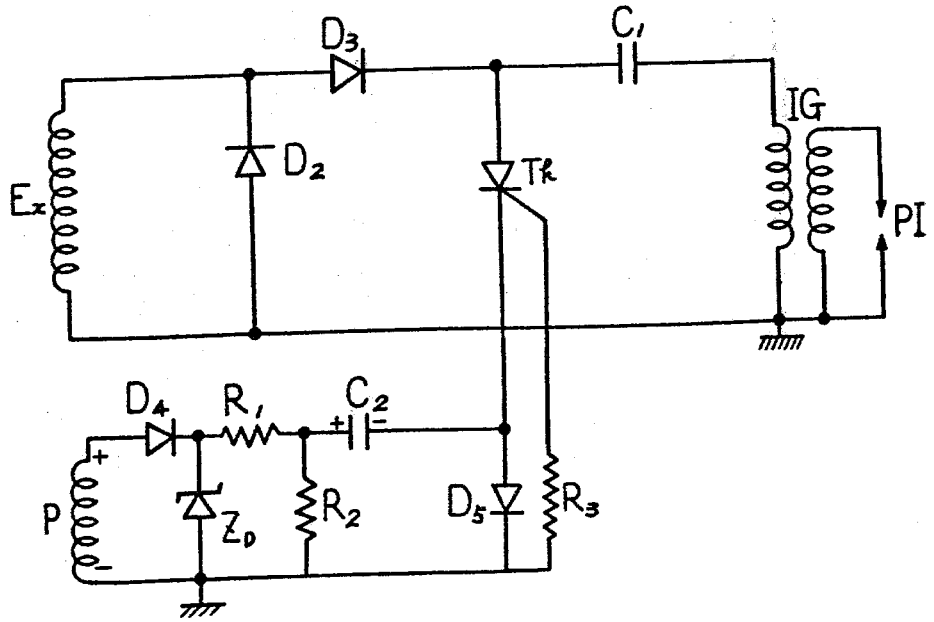
FIG. 6 is a circuit diagram of a third embodiment of this invention.

FIG. 6 is a circuit diagram of a third embodiment of this invention. Similarly, identified components of FIG. 6 are the same as or equivalent to those shown in FIGS. 1 and 4. When the voltage having a polarity as shown in FIG. 2(P) is generated in the pick-up coil P, the condenser C2 is charged through the circuit of the coil P, the diode D4, the resistor R1, the condenser C2, the diode D5, ground, and the coil P. Within the range where the peak value of the generated voltage does not exceed the zener voltage of the zener diode ZD, the charged voltage of the condenser C2 increases with the rise of the generated voltage. When the generated voltage from the coil P passes its peak and starts to decrease, the charge of the condenser C2 flows into the circuit including the resistor R2, the resistor R3, the gate of the thyristor Th, the cathode of the thyristor Th, and back to the condenser C2, whereby the thyristor Th is triggered and generates a discharge at the spark plug PI. In this case, therefore, the peak point of the voltage waveform generated by the pick-up coil P is the ignition timing, such as typified by the ignition pulse N1 of FIG. 2(B).

Again, when the engine speed increases and the voltage generated by the coil P exceeds the zener voltage of the zener diode ZD, current flows through the circuit of the coil P, the diode D4, the zener diode ZD, ground, and back to the pick-up coil P, so that the terminal voltage of the condenser C2 is clamped to a fixed value. When the generated voltage from the coil P passes the peak point of its waveform and falls again below the zener voltage, the condenser C2 discharges by way of the resistor R2, ground, the resistor R3, the gate of the thyristor Th, the cathode of the thyristor Th and back to the condenser C2, whereby the thyristor Th is triggered to fire the spark plug PI. Therefore, and similar to the previously described embodiments, the higher the generated voltage of the pick-up coil P increases as a result of increasing engine speed, the more the ignition timing is retarded.

It should be apparent from the foregoing description that in accordance with the present invention, while the engine speed is within a low range, the ignition timing of the spark plug is regulated to be practically constant. However, when the engine speed exceeds a preset value, the higher the engine speed increases the more the ignition timing is retarded in proportion thereto. In the foregoing, although the invention is described by referring to several embodiments, it should be understood that the invention is not limited thereto, but a variety of variations may be possible.

Accordingly, having fully described my invention, it is to be understood that I am not to be limited to the details herein set forth but that my invention is of the full scope of the appended claims.

I claim:

1. An ignition timing control system for use with an internal combustion engine which employs an ignition circuit including a capacitor charged by an exciter coil and a switching element responsive to a trigger signal for discharging the capacitor, the control system comprising pick-up means for generating an electrical signal synchronized with the speed of an engine, the amplitude of the signal being proportional to the speed of the engine, rectifier means connected with the pick-up means for rectifying the generated signal, limit circuit means connected in parallel with the pick-up means for limiting the amplitude of the rectified signal to a predetermined value representing a predetermined engine speed, and trigger circuit means connected with the limit circuit means for detecting a preset falling point of the limited rectified signal waveform for generating trigger signals for the switching element of the ignition circuit of the engine to provide substantially constant ignition timing below said predetermined engine speed and to progressively retard the ignition timing as the engine speed increases above said predetermined engine speed, said trigger circuit means including capacitor means connected in parallel with the pick-up means and including switching means connected between the switching element of the ignition circuit and capacitor means, said capacitor means discharging at a preset falling point of the limited rectified signal waveform from said limit circuit means.

2. An ignition timing control system as in claim 1 wherein said switching means comprises a transistor switch connected with the switching element of the ignition circuit.

3. An ignition timing control system as in claim 1 wherein said switching means comprises a diode connected with the switching element of the ignition circuit.

4. An ignition timing control system as in claim 3, wherein said limit circuit means comprises a zener diode, and said rectifier means and zener diode are connected in series across said pick-up means.

5. An ignition timing control system for use with an internal combustion engine which employs an ignition circuit including a capacitor charged by an exciter coil and a switching element responsive to a trigger signal for discharging the capacitor, the control system comprising pick-up means for generating an electrical signal synchronized with the speed of an engine, said signal being an AC voltage having an amplitude which increases with increasing engine speed, capacitor means connected in parallel with said pick-up means, voltage limiting means connected in parallel with said pick-up means for limiting the amplitude of the signal from said pick-up means to a predetermined value, and a trigger circuit comprising semiconductor switch means connected between the switching element of the ignition circuit and said capacitor means for detecting a preset falling point of the signal from said pick-up means for generating trigger signals for the switching element of the ignition circuit which are progressively retarded as engine speed increases above a predetermined speed which is a function of the predetermined value established by said voltage limiting means, said capacitor means discharging at a preset falling point of the limited signal waveform from said voltage limiting means, and wherein the ignition timing is substantially constant below said predetermined speed and as the amplitude of the signal from the pick-up means increases above the predetermined value established by the voltage limiting means said preset falling point occurs progressively later as the signal from said pick-up means falls toward zero and crosses said predetermined value established by said voltage limiting means.

6. An ignition timing control system as in claim 5 wherein said semiconductor switch means comprises a transistor.

7. An ignition timing control system as in claim 5 wherein said semiconductor switch means comprises a diode.

8. An ignition timing control system for use with an internal combustion engine which employs an ignition circuit including a capacitor charged by an exciter coil and a switching element responsive to a trigger signal for discharging the capacitor, the control system comprising pick-up means for generating an electrical signal synchronized with the speed of an engine, the amplitude of the signal being proportional to the speed of the engine, rectifier means connected with the pick-up means for rectifying the generated signal, limit circuit means connected in parallel with the pick-up means for limiting the amplitude of the rectified signal to a predetermined value representing a predetermined engine speed, capacitor means connected with said pick-up means, said capacitor means discharging at a preset falling point of the limited rectified signal waveform from said limit circuit means, and trigger circuit means comprising switching means connected with the limit circuit means for detecting the preset falling point of the limited rectified signal waveform for generating trigger signals for the switching element of the ignition circuit of the engine to provide substantially constant ignition timing below said predetermined engine speed and to progressively retard the ignition timing as the engine speed increases above said predetermined engine speed, said switching means comprising an electronic switch connected between the switching element of the ignition circuit and said capacitor means.

9. An ignition timing control system for use with an internal combustion engine which employs an ignition circuit including a capacitor charged by an exciter and a switching element responsive to a trigger signal for discharging the capacitor, the control system comprising pick-up means for generating an electrical signal sychronized with the speed of an engine, the amplitude of the signal being proportional to the speed of the engine, rectifier means connected with the pickup means for rectifying the generated signal, limit circuit means connected in parallel with the pick-up means for limiting the amplitude of the rectified signal to a predetermined value representing a predetermined engine speed, capacitor means connected with said pick-up means, said capacitor means discharging at a preset falling point of the limited rectified signal waveform from said limit circuit means, and trigger circuit means comprising switching means connected with the limit circuit means for detecting the preset falling point of the limited rectified signal waveform for generating trigger signals for the switching element of the ignition circuit of the engine to provide substantially constant ignition timing below said predetermined engine speed and to progressively retard the ignition timing as the engine speed increases above said predetermined engine speed, said switching means comprising an transistor switch connected between the switching element of the ignition circuit and said capacitor means.

10. An ignition timing control system for use with an internal combustion engine which employs an ignition circuit including a capacitor charged by an exciter and a switching element responsive to a trigger signal for discharging the capacitor, the control system comprising pick-up means for generating an electrical signal synchronized with the speed of an engine, the amplitude of the signal being proporational to the speed of the engine, rectifier means connected with the pick-up means for rectifying the generated signal, limit circuit means connected in parallel with the pick-up means for limiting the amplitude of the rectified signal to a predetermined value representing a predetermined engine speed, capacitor means connected with said pick-up means, said capacitor means discharging at a preset falling point of the limited rectified signal waveform from said limit circuit means, and trigger circuit means comprising switching means connected with the limit circuit means for detecting the preset falling point of the limited rectified signal waveform for generating trigger signals for the switching element of the ignition circuit of the engine to provide substantially constant ignition timing below said predetermined engine speed and to progressively retard the ignition timing as the engine speed increases above said predetermined engine speed, said switching means comprising an diode switch connected between the switching element of the ignition circuit and said capacitor means.

* * * * *

UNITED STATES PATENT AND TRADEMARK OFFICE

CERTIFICATE OF CORRECTION

PATENT NO. : 4,335,692

DATED : June 22, 1982

INVENTOR(S) : Nobuo Miura

It is certified that error appears in the above—identified patent and that said Letters Patent is hereby corrected as shown below:

Title page, first column, the Japanese priority application was filed Nov. 27, 1978, Column 3, lines 45 and 50, "slopping" should read --sloping--.

Column 3, line 53, "transistion" should read --transition--.

Signed and Sealed this

*Thirty-first* Day of *August 1982*

[SEAL]

*Attest:*

GERALD J. MOSSINGHOFF

*Attesting Officer*

*Commissioner of Patents and Trademarks*